US006223929B1

(12) United States Patent
Gerhard

(10) Patent No.: US 6,223,929 B1
(45) Date of Patent: May 1, 2001

(54) PRESSURE-PROOF TANK

(75) Inventor: Till Gerhard, Munich (DE)

(73) Assignee: Wew Westerwaelder Eisenwerk GmbH, Weitefeld (DE)

( * ) Notice: Subject to any disclaimer, the term of this patent is extended or adjusted under 35 U.S.C. 154(b) by 0 days.

(21) Appl. No.: 09/610,030

(22) Filed: Jul. 5, 2000

(30) Foreign Application Priority Data

Jul. 5, 1999 (DE) ..... 299 11 640 U

(51) Int. Cl.[7] ..... B65D 1/24
(52) U.S. Cl. ..... 220/581; 220/565
(58) Field of Search ..... 220/581, 565, 220/567.1, 567.2, 584

(56) References Cited

U.S. PATENT DOCUMENTS 2,673,001 * 3/1954 Ulm et al. ..... 220/565
2,705,349 * 4/1955 Shaw ..... 220/565 X
2,818,191 * 12/1957 Arne ..... 220/565
2,975,927 * 3/1961 Arne ..... 220/565
3,112,044 * 11/1963 Larsen et al. ..... 220/565
3,314,567 * 4/1967 Becker et al. ..... 220/565 X
3,414,153 * 12/1968 Leroux ..... 220/565
3,645,415 * 2/1972 Phelps ..... 220/565

FOREIGN PATENT DOCUMENTS

3125963 A1 2/1983 (DE) .
3606247 C1 5/1987 (DE) .

* cited by examiner

*Primary Examiner*—Steven Pollard
(74) *Attorney, Agent, or Firm*—Connolly Bove Lodge & Hutz LLP

(57) ABSTRACT

A pressure-proof tank for a transport container has an envelope formed by two or more parallel part-cylindrical envelope shells 1, the ends of which are closed by bottoms 2 formed of bottom shells 3. The transition region between the bottom and envelope shells 2, 3, is closed by curved gusset elements 5. The pressure resistance in this transition region is improved by planar rib elements 10 extending through the interior of the tank. The rib elements 10 cooperate with a tension wall 4, which divides the tank in the longitudinal direction, to reduce the effect of surges acting in the transport direction, especially when the tank is partially filled.

16 Claims, 4 Drawing Sheets

PRESSURE-PROOF TANK

BACKGROUND OF THE INVENTION

The present invention relates to a pressure-proof tank, specifically a pressure-proof tank for a transport container.

German Offenlegungsschrift 3,125,963 disclosed a pressure-proof tank which comprises an envelope formed by part-cylindrical envelope shells extending parallel to the longitudinal tank axis, the ends of the envelope being closed by bottoms formed by bottom shells. Gusset elements are disposed between the envelope and bottom shells.

The known tank is designed as a thick-walled receptacle for liquid gas as fuel for vehicle motors. The tank is made of one fully cylindrical shell and one part-cylindrical shell, with the part of the full cylinder extending through interior of the tank forming an intermediate wall, which may be flattened.

Membrane stresses in the curved tank skin caused by interior pressure lead to forces in the zones where the curved shell elements converge. These forces tend to expand the tank in a direction perpendicular to the tank axis.

A similar tank for high-volume containers with curved gusset elements, which is similarly problematic in terms of membrane stresses, is known from German patent specification 3,606,247.

SUMMARY OF THE INVENTION

It is an object of the present invention is to avoid stress problems in the transition region between the envelope shells and bottom shells, especially in high-volume tanks.

This object is met in accordance with the invention by a pressure-proof tank defining a longitudinal tank axis and comprising an envelope having ends and being formed by part-cylindrical envelope shells extending parallel to the tank axis, bottoms closing the ends and being formed by bottom shells defining bottom shell axes perpendicular to the tank axis, curved gusset elements disposed between the envelope shells and the bottom shells, and a pair of planar rib elements extending through the interior of the tank in planes transverse to the plane defined by the tank axis and the bottom shell axes, wherein the gusset elements are connected to the envelope shells through said rib elements.

In accordance with the invention, forces resulting from the membrane stresses explained above are absorbed by rib elements which extend through the tank in the direction of these forces. The rib elements are disposed between the converging envelope shells and gusset elements so that the various structural elements can be connected by fillet welds which are particularly easy to make.

The rib elements of the invention form an integral component of the tank, which ensures high pressure resistance of the entire tank, provides favourable continuous stress characteristics and acts as a damping element to counteract surge effects in both longitudinal and transverse directions.

As another advantage of the tank structure provided by the present invention, a container including the tank has a low centre of gravity as is particularly suitable for high-wheeled off-road vehicles, thereby further decreasing surge effects which tend to occur especially when the tank is only partially filled.

In a preferred embodiment, the rib elements are integrally formed by two wing portions of one bent metal sheet. This reduces the amount of welding work and the number of welded joints.

In accordance with another preferred embodiment, the tank comprises a profile element extending through the interior of the tank perpendicularly to the tank axis an welded to the rib elements. The profile element constitutes a tie rod cooperating with the rib elements to further reduce tensile forces exerted on the tank skin.

A hollow circular or Y-shaped cross-sectional shape of the profile element is advantageous in that it further avoids an accumulation of weld joints, especially in the zone where the longitudinally and diagonally extending beads formed between the envelope and bottom shells meet.

Additional reinforcement of the overall tank structure may be achieved by a planar tension wall extending through the interior of the tank in a plane containing the tank axis. The tension wall may have a portion protruding out of the tank and including a leg extending transversely of the plane of the tension wall to avoid buckling.

Preferably, the surface of the leg remote from the tank is coplanar with a plane defined by vertex lines of the envelope shells. This structure permits the bead zone formed between the envelope shells to be sealed by a flat plate. The resulting stabilised surface can serve as an operation platform or for fixing additional components in the upper tank region. In the lower region, the leg of the tension wall may serve as a support surface of the overall tank.

The rib elements are preferably welded to the tension wall or to the profile element to achieve a further stabilisation of the entire structure.

A structure which is especially favourable from the manufacturing standpoint is obtained if one of the rib elements and the tension wall are integrally formed by one metal sheet having a bend, with the other rib element being welded to the sheet along the bend.

DETAILED DESCRIPTION OF PREFERRED EMBODIMENTS

Figure 1:
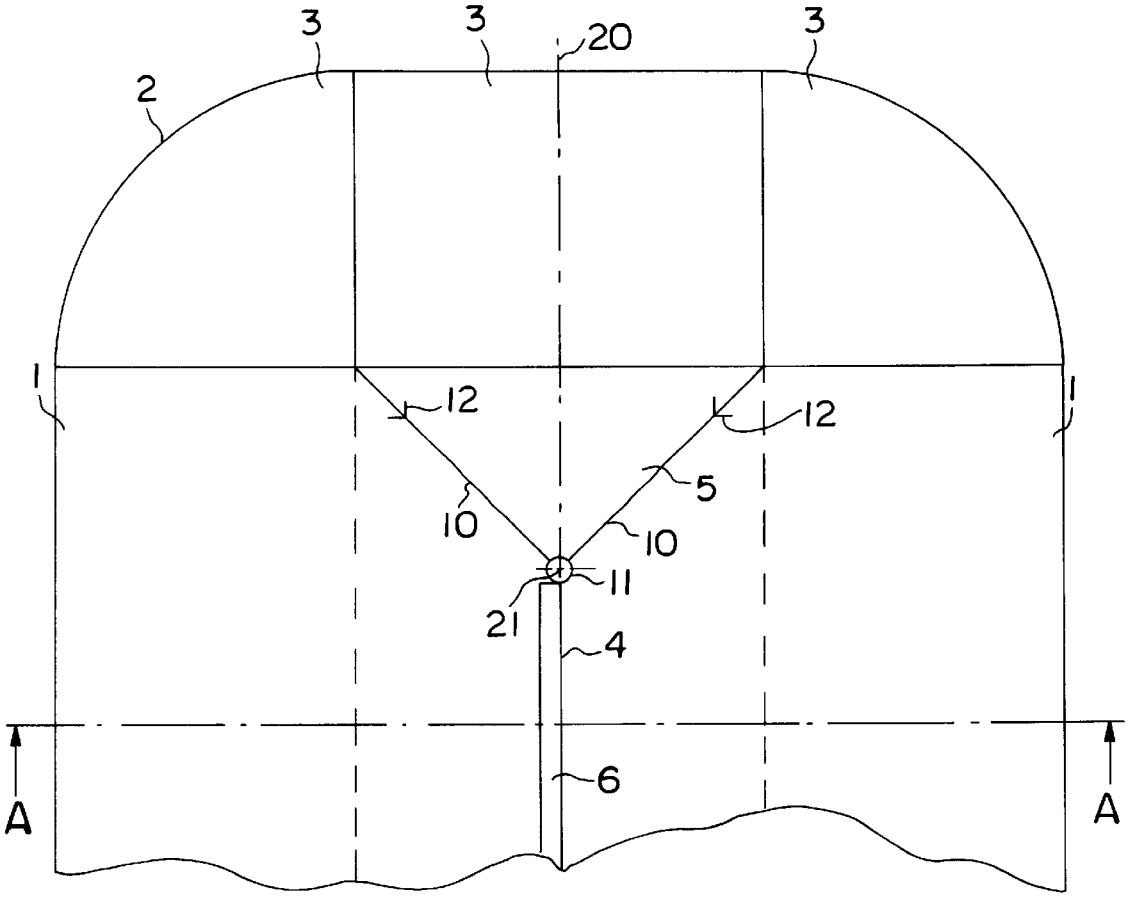
FIG. 1 is a plan view showing part of a tank made of two shells.
Figure 2:
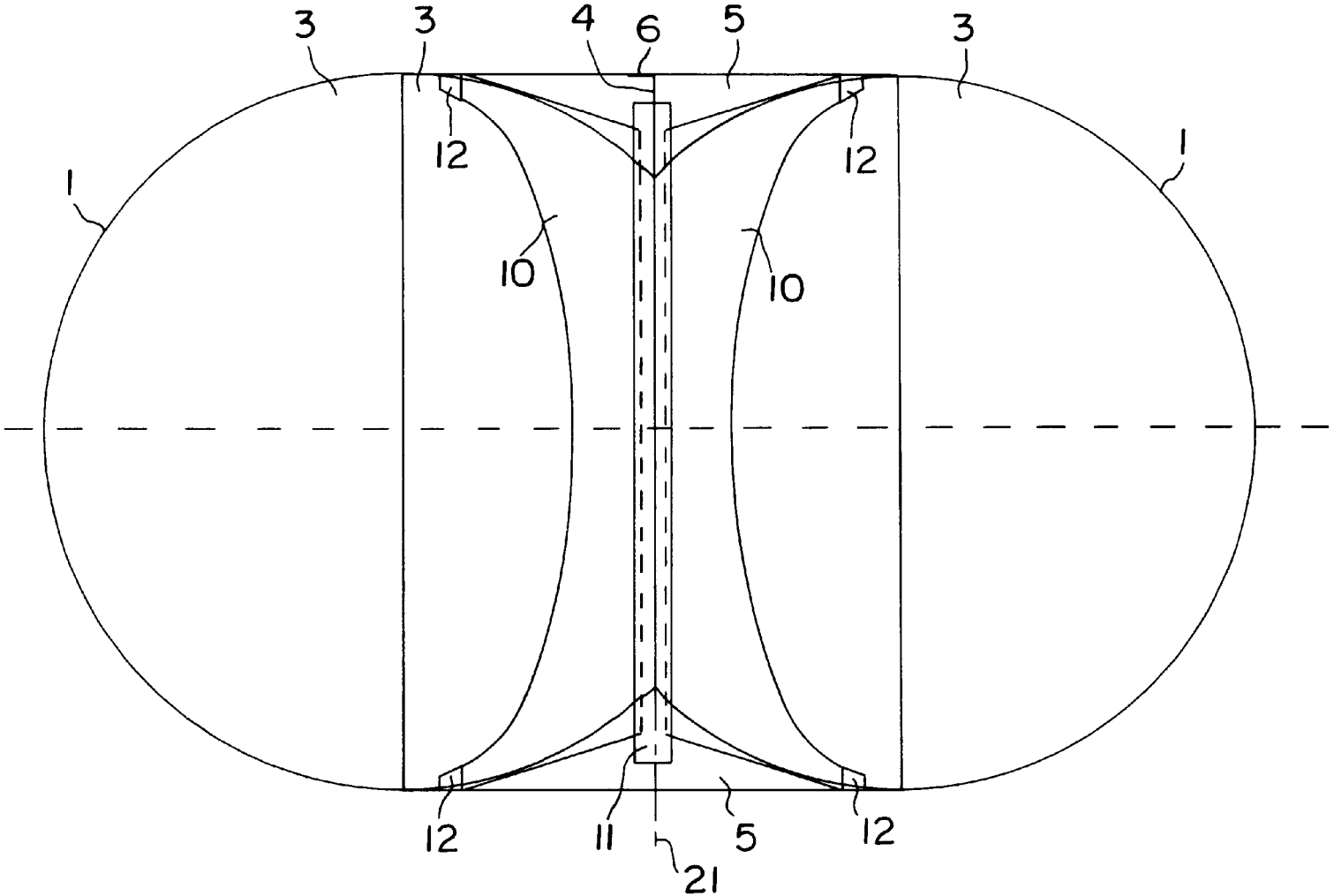
FIG. 2 is a vertical cross-section of the tank of FIG. 1 taken along the line A—A.

The tank of FIGS. 1 and 2 consists of two part-cylindrical envelope shells 1, which are interconnected by a tension wall 4 extending parallel to the longitudinal tank axis 20 across the entire tank. The envelope shells 1 form two recesses within the outer tank profile which extend as bead-shaped grooves parallel to the tank axis 20 at the upper and lower sides of the tank.

The ends of the tank are closed by a pair of bottoms 2 each consisting of three bottom shells 3. In the embodiment of FIGS. 1 and 2 these bottom shells 3 include two quarter-spherical shell sectors and a half-cylindrical shell inserted therebetween. The axis of the half-cylindrical shell extends horizontally and transversely to the longitudinal tank axis 20.

The transition between the half-cylindrical bottom shell 3 and the envelope shells 1 is formed by a cylindrically curved gusset element 5 which has a tip portion starting at the bead between the two envelope shells 1 and extending to the points where the envelope shells 1 meet with the bottom shells 3. In FIGS. 1 and 2, the shells 1 and 3 and the gusset element 5 have the same radius of curvature.

Sickle-shaped rib elements 10 are inserted between the gusset element 5 and the envelope shells 1. These rib elements 10 extend through the interior of the tank, each at an angle of 45° with respect to the longitudinal tank axis 20. The rib elements 10 are connected to the tension wall 4 through a tubular profile element 11 which extends through the tank along a vertical axis 21.

Figure 7B:
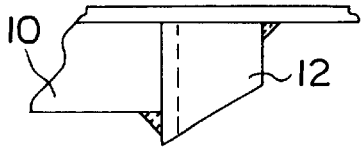
FIGS. 7*a* and 7*b* are a side view and a plan view of a stress-relieving end piece connecting a rib element to the envelope shells and bottom shells of the tank.
Figure 7A:
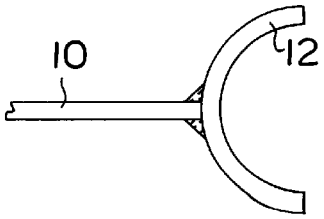

The outer end of each rib element 10 is connected to the envelope shells 1 and bottom shells 3 near the vertex and base points of the tank by means of stress-relieving end pieces 12 respectively. FIG. 7 shows an embodiment of such end piece 12 in the form of a bevelled part-cylindrical claw. Alternative embodiments of the end piece include tubular elements, doubling plates or curved elements sealed to the interior of the tank.

Figure 3:
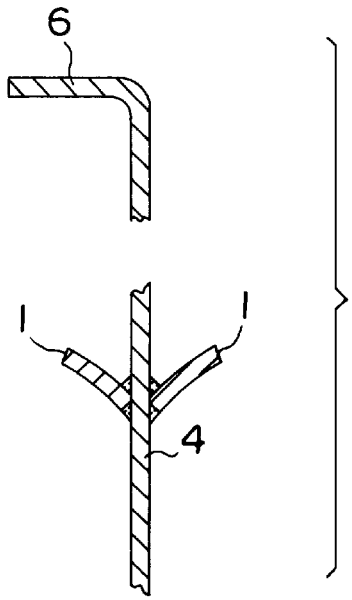
FIG. 3 is a sectional view of the connection between the envelope shells and a tension wall, taken in the direction of the longitudinal tank axis.

FIG. 3 shows the envelope shells 1 connected to the tension wall 4 by fillet welds 11. The tension wall 4 has a portion protruding out of the tank and including a leg 6 extending transversely of the plane of said tension wall 4. The outer surface of the leg 6 is coplanar with plane defined by the vertex lines of the two envelope shells 1.

In an alternative embodiment (not shown), the tension wall extends only internally of the tank and is welded between the longitudinally extending inner edges of the upper and the lower beads formed by the envelope shells 1.

Figure 4A:
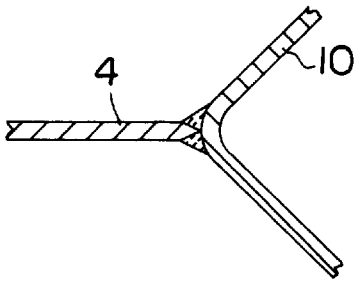
FIGS. 4*a,* 4*b,* 5 and 6 are sectional views taken in a direction perpendicular to the tank axis and showing various embodiment of the connection between rib elements and the tension wall.

FIG. 4*a* shows an embodiment in which the rib elements 10 are integrally formed by two wing portions of one bent metal sheet disposed symmetrically with respect to the tension wall 4. The tension wall 4 is welded to the bend along the vertical axis 21.

Figure 4B:
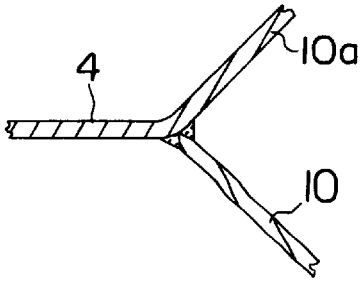

In the modification of FIG. 4*b,* one rib element is an integral bent portion 10*a* of the tension wall 4 and the other rib element 10 is welded to the bend along the vertical axis 21. In this case, the rib element 10 should have the same thickness as the tension wall 4 and the rib element 10*a*.

Figure 5:
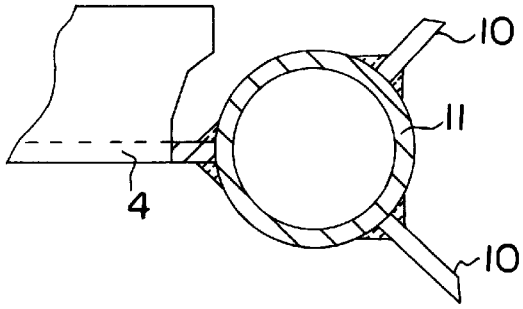

FIG. 5 shows the interconnection between the tension wall 4 and the rib elements 10 through the tubular profile element 11, the longitudinal axis of which coincides with the vertical axis 21. In this case, the welds are distributed about the circumference of the tubular element 11. The edges of the envelope shells 1 and of the gusset element 5 are cut to conform with the circumference of the tubular element 11, so that the various welds do not meet at one point.

Moreover, a hollow profile element, such as the tubular element 11, constitutes a communication between the upper and lower bead spaces of the tank, which is an interesting feature in a double walled tank structure (not shown) in which the tank is completely enclosed in an outer envelope and the bead spaces between the envelope shells 1 form cavities between the tank and the outer envelope. In this case, the space between the tank and the outer envelope may be completely filled with a fluid through the communicating connections, and the upper space can be readily drained downward if necessary. Also, the space may be filled with a leak detection liquid. One single leak detector would be sufficient to monitor the tightness of the overall tank structure.

Figure 6:
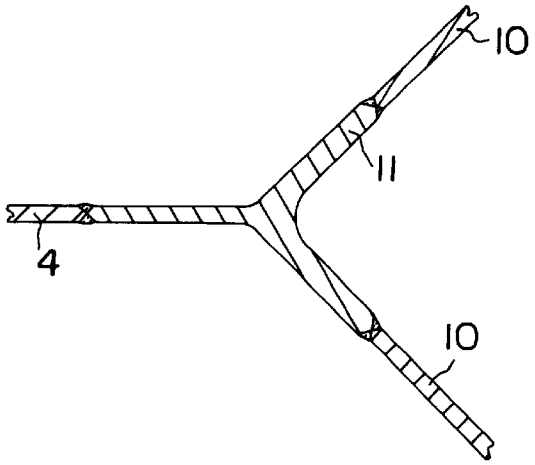

FIG. 6 shows a profile element 11 of solid structure. Again, the welds connecting the rib elements 10 to the tension wall 4 are spaced apart. As an alternative to the Y cross-section shown in FIG. 6, the profile element may have an L-shaped or angular profile in which the tension wall 4 would welded to the corner and the rib elements 10 to the ends of the profile.

The invention is not restricted to tanks having an envelope formed of two envelope shells; it is also applicable to tanks having three or more part-cylindrical envelope shells will parallel longitudinal axes extending in one plane.

What is claimed is:

1. A pressure-proof tank defining a longitudinal tank axis and comprising an envelope having ends and being formed by part-cylindrical envelope shells extending parallel to said tank axis, bottoms closing said ends and being formed by bottom shells defining bottom shell axes perpendicular to said tank axis, curved gusset elements disposed between said envelope shells and said bottom shells, and a pair of planar rib elements extending through the interior of the tank in planes transverse to the plane defined by said tank axis and said bottom shell axes, wherein said gusset elements are connected to said envelope shells through said rib elements.

2. The tank of claim 1, wherein said envelope shells, said bottom shells and said gusset elements have the same radius of curvature.

3. The tank of claim 1, wherein said rib elements are formed by two wing portions of one bent metal sheet.

4. The tank of claim 1, wherein each said rib element has a sickle-shaped profile.

5. The tank of claim 1, further comprising a profile element extending through the interior of the tank perpendicularly to said tank axis and being welded to said rib elements.

6. The tank of claim 5, wherein said profile element is hollow.

7. The tank of claim 6, wherein said profile element has a circular cross-section.

8. The tank of claim 5, wherein said profile element has an angular profile.

9. The tank of claim 5, wherein said rib elements are welded to said profile element.

10. The tank of claim 5, wherein said profile element has a Y-profile.

11. The tank of claim 1, further comprising a planar tension wall extending through the interior of the tank in a plane containing said tank axis.

12. The tank of claim 11, wherein said tension wall has a portion protruding out of the tank and including a leg extending transversely of the plane of said tension wall.

13. The tank of claim 12, wherein the surface of said leg remote from the tank is coplanar with a plane defined by vertex lines of said envelope shells.

14. The tank of claim 11, wherein said rib elements are welded to said tension wall.

15. The tank of claim 14, wherein one of said rib elements and said tension wall are integrally formed by one metal sheet having a bend, and the other one of said rib elements is welded to said sheet along said bend.

16. The tank of claim 1, further comprising stress reducing end pieces connecting end portions of said rib elements to said envelope shells and bottom shells.

* * * * *